United States Patent [19]

Conti

[11] 4,062,466

[45] Dec. 13, 1977

[54] TAMPER-PROOF CLOSURE CAP WITH SELF-REMOVING RING

[75] Inventor: Vincent N. Conti, West Hempstead, N.Y.

[73] Assignee: Dairy Cap Corporation, Long Island City, N.Y.

[21] Appl. No.: 730,591

[22] Filed: Oct. 7, 1976

[51] Int. Cl.[2] ..... B65D 41/34

[52] U.S. Cl. ..... 215/252

[58] Field of Search ..... 215/252, 253, 256

[56] References Cited

U.S. PATENT DOCUMENTS

| | | | |
|---|---|---|---|
| 3,504,818 | 4/1970 | Crisci | 215/252 |
| 3,650,428 | 3/1972 | Miller | 215/252 |
| 3,902,621 | 9/1975 | Hidding | 215/252 |

*Primary Examiner*—Donald F. Norton

*Attorney, Agent, or Firm*—Pennie & Edmonds

[57] ABSTRACT

A tamper-proof container closure cap is provided with a self-removing ring which breaks away from the cap in a strip as the cap is twisted open. Specifically, the cap is provided with a pawled ring which is split, frangibly attached to the cap adjacent each end, and free of engagement with the cap for a substantial distance in the direction opposing cap twist off. This structure effects removal of the ring from both the cap and the container as the cap is twisted off.

6 Claims, 3 Drawing Figures

TAMPER-PROOF CLOSURE CAP WITH SELF-REMOVING RING

BACKGROUND OF THE INVENTION

The present invention relates to tamper-proof container closures and, more particularly, to a tamper-proof container closure cap with a self-removing ring.

Tamper-proof container closures are widely used, particularly in the dairy industry, to demonstrate to the final consumer that the contents of a container have not been contaminated or adulterated subsequent to bottling. One type of tamper-proof container closure employs a separable ring member having a plurality of triangular pawls to prevent such tampering. The ring is coupled to the cap by frangible elements located at discrete points around the cap. When the cap is twisted open, the pawls of the ring lock into engagement with corresponding teeth on the container, breaking the frangible elements, and separating the ring from the cap. Such closures are described in greater detail in U.S. Pat. No. 3,874,540 issued to W. E. Hidding; U.S. Pat. No. 3,504,818 issued to H. Crisci et al.; and U.S. Pat. No. 3,249,247 issued to P. H. Babiol.

One problem with these types of closures is proper disposition of the ring after separation. If the ring is secured to the container, it remains as an unsightly toothed structure permitting the collection of dirt and bacteria in tiny corners. If the ring is not secured to the container, it will either fall off during pouring from the container or it must be removed manually. Manual removal, which is usually effected after the cap is twisted off, almost inevitably results in unsanitary manual contact with the mouth of the container.

In an attempt to overcome the problem of ring disposition, the industry has begun to provide the rings with handles so that they may be manually torn from the container and cap prior to removing the cap. Such handles, however are typically small molded structures readily subject to premature breakage. Moreover, the handles are typically secured to the ring by one or more frangible connections which must be manually broken before the handle can be pulled to tear the ring away.

SUMMARY OF THE INVENTION

In accordance with the present invention, a tamper-proof container closure cap is provided with a self-removing ring which breaks away from the cap in a strip as the cap is twisted open. Specifically, the cap is provided with a pawled ring which split, frangibly attached to the cap adjacent each end, and free of engagement with the cap for a substantial distance in the direction opposing cap twist off. This structure effects removal of the ring from both the cap and the container as the cap is twisted off.

BRIEF DESCRIPTION OF THE DRAWINGS

The advantages, nature, and various additional features of the present invention will appear more fully upon consideration of the illustrative embodiment now to be described in detail in connection with the accompanying drawings in which.

For convenience of reference, the same structural elements are denoted by the same reference numerals throughout the drawing.

DETAILED DESCRIPTION

Figure 1:
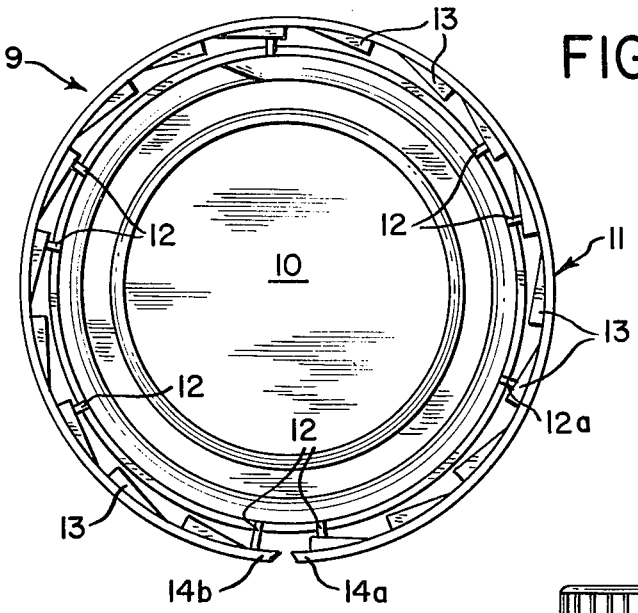
FIG. 1 is a bottom view of a typical closure in accordance with the invention.
Figure 2:
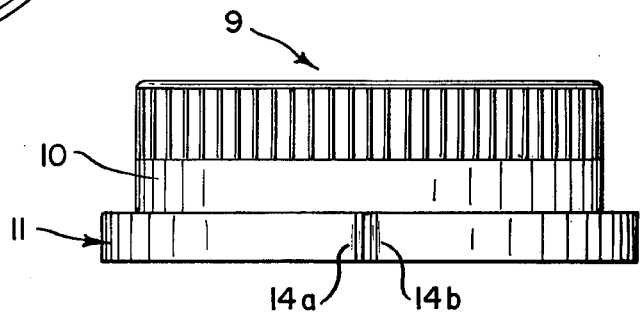
FIG. 2 is a side view of the closure shown in FIG. 1.

Referring to the drawings, FIGS. 1 and 2 are bottom and side views, respectively, of a typical closure in accordance with the invention. The closure 9 comprises a threaded cap 10 and a split ring 11 coupled to the cap by a plurality of frangible elements 12. The split ring 11 includes a plurality of triangular pawls 13 extending radially inwardly for interlocking with a plurality of teeth on a container (Elements 16 of FIG. 3). Frangible elements 12 are disposed adjacent each end **14*a* and 14*b* of the split ring, but after the end element 14aa, the ring is free of engagement with the cap for a substantial distance in the direction opposing cap twist off, i.e., after the end element the next frangible element 12a** is located so that the ring is free of additional frangible elements for an angular distance in excess of about 30°. The closure is preferably molded of a flexible plastic material.

Figure 3:
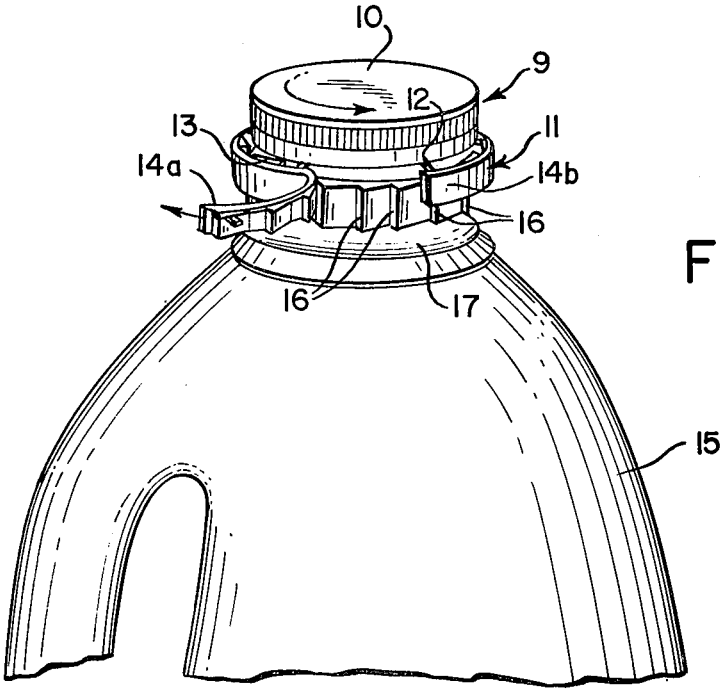
FIG. 3 is an action perspective view of the closure in position on a container and showing the ring stripping from the cap and the container as the cap is twisted off.

The use and operation of this closure on a container is illustrated in FIG. 3 which is an action perspective view in which the cap 10 of the closure is being twisted off a container 15. In preliminary operations, the container has been filled (contents not shown), and closure 9 has been twisted down onto a correspondingly threaded mouth 17 of the container. In the "twist on" direction, the pawls 13 of ring 11 have a gradual slope so that they slide over the teeth 16 of the container. In the "twist off" direction, however, the pawls have an abrupt slope and they interlock with the container teeth to prevent the ring from turning with the cap 10. As torque is applied to twist off the cap, the ring initially bend radially outward in the unengaged region subsequent to end **14*a*, and then the torque shears the frangible element adjacent 14*a*, permitting the ring to strip off both the cap 10 and the container 15. A similar sequence typically strips off the remainder of the ring as the cap is twisted off. However, in the event the ring does not completely strip off, the initial strip comprising the portion adjacent end 14*a*** provides a ready means for manual removal of the remainder.

In the preferred embodiment, which is made of high density polyethylene, pawls are distributed around the ring every 20° of circumference except at end **14*b*. The frangible elements are all connected to pawls except, again, at end 14*b* where the element connects directly to the ring. The advantage of this structure is that the direct connection near end 14*b*** does not readily break upon twist off, leaving a dangling strip to indicate tampering.

While the invention has been described in connection with a specific embodiment, it is to be understood that this embodiment is merely illustrative of many other specific embodiments which can also utilize the principles of the invention. Thus, numerous and varied devices can be made by those skilled in the art without departing from the spirit and scope of the present invention.

I claim:

1. A tamper-proof container closure for a container having a threaded mouth portion and a plurality of teeth members adjacent said mouth portion, said closure comprising:

a threaded cap for engaging the mouth portion of said container;

a split ring having a pair of separated ends frangibly coupled to said threaded cap, said split ring including a plurality of pawls for interlockably engaging said plurality of teeth members on said container when the closure is rotated in the direction of cap twist off and the portion of said split ring adjacent to one end being free of engagement with said cap for a substantial length in the direction opposing cap twist off.

2. A closure according to claim 1 wherein each end of said split ring is coupled to said cap by respective frangible elements and where the next frangible element in the direction opposing cap twist off is disposed at least 30° of circumference further along said split ring.

3. A closure according to claim 1 wherein said ring is coupled to said cap by a plurality of frangible elements connecting said cap to said pawls on said ring and by at least one frangible element connected directly to said ring adjacent one end of said split ring.

4. A closure according to claim 1 wherein said closure is made of high density polyethylene.

5. A closure according to claim 1 wherein said pawls are distributed around said ring in twenty degree intervals except adjacent one end of said split ring, which end has no pawl.

6. A closure according to claim 1 wherein said portion of substantial length is the largest portion of said ring free of engagement with said cap.

* * * * *